United States Patent [19]

Broussard

[11] Patent Number: 4,522,394

[45] Date of Patent: Jun. 11, 1985

[54] COLLAPSIBLE, MOVABLE APPARATUS FOR SUPPORTING HEALTH-SPORTS DEVICES

[76] Inventor: Alphe Broussard, 64 Avenue Mohamed Diouri, Kenitra, Morocco

[21] Appl. No.: 624,954

[22] Filed: Jun. 27, 1984

[51] Int. Cl.[3] ..... A63B 63/08; A63B 69/22

[52] U.S. Cl. ..... 273/1.5 R; 74/411.5; 74/422; 74/528; 188/72.8; 188/83; 248/161; 272/78; 273/347

[58] Field of Search ..... 273/1.5 R, 1.5 A, 347; 272/62, 78; 248/161, 404; 188/83, 85, 72.8; 74/30, 422, 411.5, 528

[56] References Cited

U.S. PATENT DOCUMENTS

| | | | |
|---|---|---|---|
| 387,345 | 8/1888 | Dickson | 248/404 X |
| 575,016 | 1/1897 | Towne | 188/83 |
| 643,286 | 2/1900 | Feiker | 188/85 X |
| 1,224,658 | 5/1917 | Morando | 272/78 |
| 1,582,487 | 4/1926 | Shank | 272/78 UX |
| 1,669,063 | 5/1928 | Mills | 272/62 X |
| 1,833,781 | 11/1931 | Fuller | 248/404 X |
| 2,429,696 | 10/1947 | Merkt | 188/83 X |
| 2,444,485 | 7/1948 | Aitcheson | 188/83 X |
| 2,484,982 | 10/1949 | Coutant | 248/404 |
| 2,984,395 | 5/1961 | Sheftel | 273/1.5 R |
| 3,017,183 | 1/1962 | Chalcroft | 273/1 R |
| 3,102,580 | 9/1963 | Greegor | 188/83 X |
| 3,182,962 | 5/1965 | Gray | 188/83 X |
| 3,198,923 | 8/1965 | Tripp | 74/528 X |
| 3,218,879 | 11/1965 | Reed | 74/528 X |
| 3,411,497 | 11/1968 | Rickey et al. | 272/62 X |
| 3,510,131 | 5/1970 | Gardner | 248/161 X |
| 3,598,406 | 8/1971 | Robinson | 273/1.5 R X |
| 3,602,504 | 8/1971 | Chapman | 273/1.5 R |
| 3,650,530 | 3/1972 | Gantz | 273/1.5 R X |
| 3,876,199 | 4/1975 | Eichenauer | 272/62 |
| 3,957,144 | 5/1976 | Opyrchal | 188/83 X |
| 4,061,300 | 12/1977 | Takahashi | 248/404 X |

FOREIGN PATENT DOCUMENTS

| | | | |
|---|---|---|---|
| 668214 | 7/1929 | France | 248/161 |
| 85239 | 6/1920 | Switzerland | 272/62 |

*Primary Examiner*—Paul E. Shapiro

*Attorney, Agent, or Firm*—Fisher, Christen & Sabol

[57] ABSTRACT

A collapsible, movable apparatus, for containing health-sports devices and equipment, which includes a telescoping post support having at least two telescoping segments and a ratchet device for moving each of the adjacent telescoping segments in relation to each other. There is a support adopted to fit slideably on the top telescoping segment without overlapping onto the next telescoping segment. A large horizontally-positioned ring is mounted on the support. A platform is pivotally mounted under the ring so as to be able to swing downwardly when unconnected from the ring. Also, a basketball backboard is vertically mounted to the top portion of the top telescoping segment. The bottom end of the telescoping post is adapted to fit into a tube positioned in the ground or other horizontal surface.

9 Claims, 11 Drawing Figures

FIG. 5
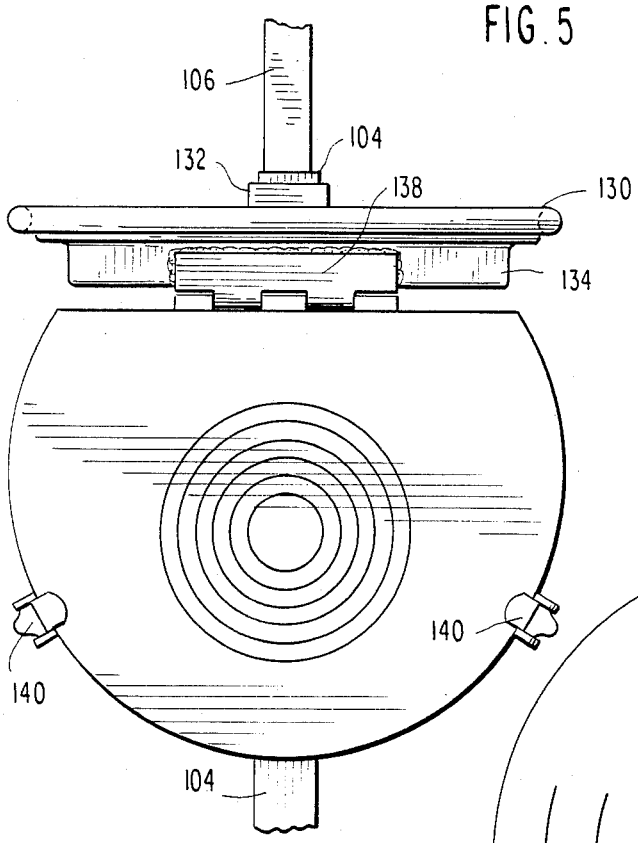
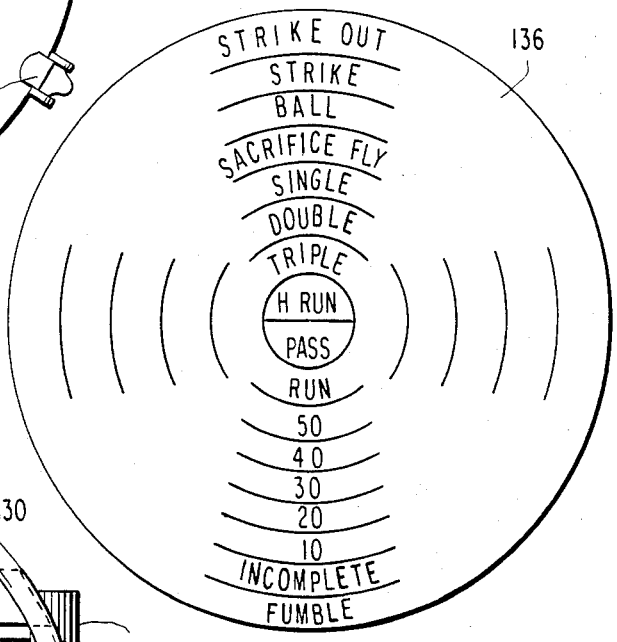
FIG. 7
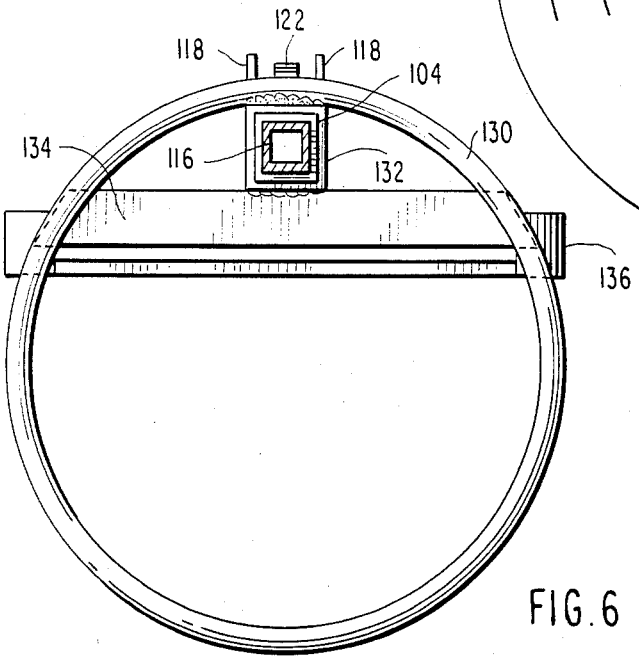
FIG. 6

FIG. 8
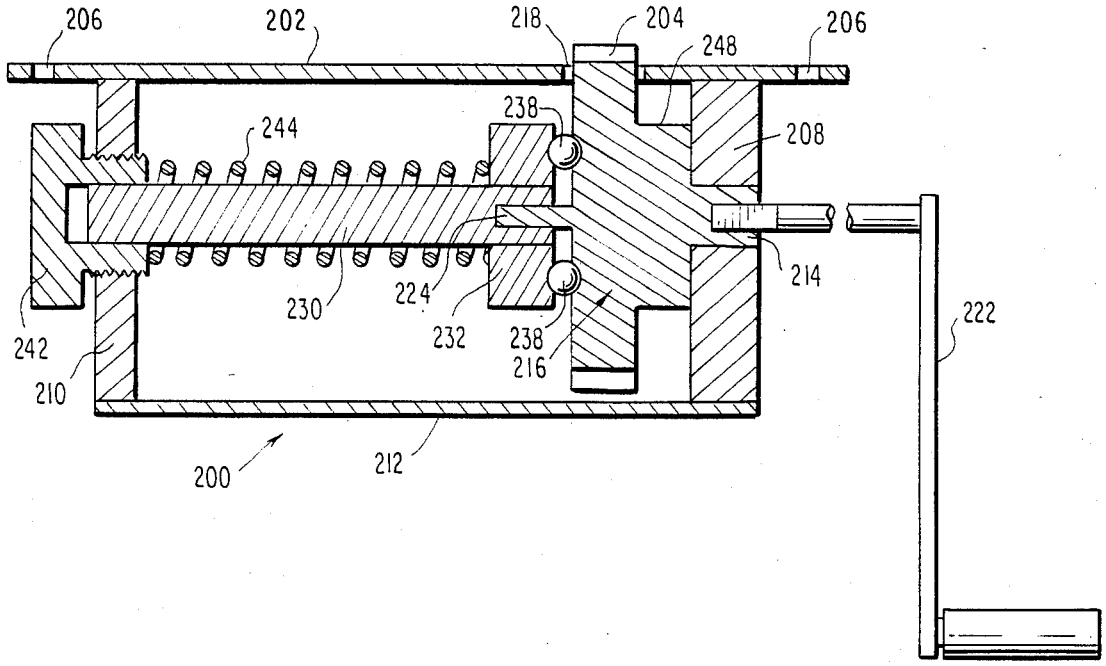
FIG. 9
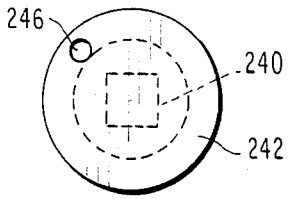
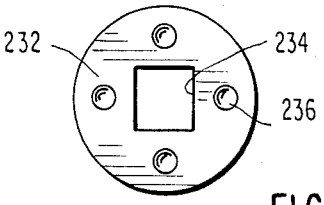
FIG. 10
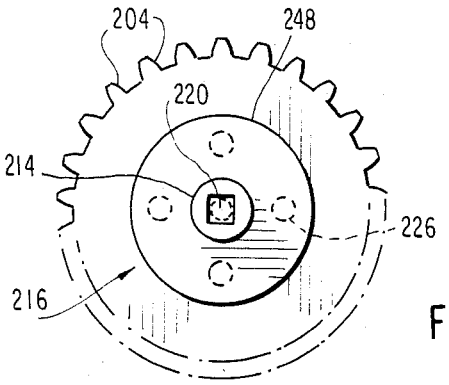
FIG. 11

COLLAPSIBLE, MOVABLE APPARATUS FOR SUPPORTING HEALTH-SPORTS DEVICES

FIELD OF THE INVENTION

The invention relates to health and support devices for children and adults.

BROAD DESCRIPTION OF THE INVENTION

An object of the invention is to provide a collapsible, movable apparatus for health, exercise and sports devices. Another object of the invention is to develop means for easy installation of multiple games of skill equipment for the participation of all concerned from a child to a fully grown individual, all making use of the same set of equipment in view of the adjustment capabilities. A further object of the invention is to develop the mechanical capabilities to instantly adjust the various equipment to the heights preferred to accommodate a child up to a fully grown individual. A still further object of the invention is to induce a father and a child to devote a greater part of their life together in a program of games of skill which will benefit both in many ways and will develop skills along with a complete exercise program for the health and development of the human body. Other objects and advantages of the invention are set out herein or are obvious to one ordinarily skilled in the art herefrom.

The objects and advantages of this invention are achieved by the apparatus of the invention.

The invention involves a collapsible, movable apparatus for containing health, sports and/or exercise devices and equipment. The apparatus includes a telescoping support, preferably having three telescoping segments. There are sufficient means for moving each set of two adjacent telescoping segments in relationship to each other. Advantageously, the means for raising and lowering the telescoping segments are a ratchet device. Preferably the means for moving the telescoping segments also incorporate braking means to prevent the upper portions of the apparatus from uncontrollably falling during the lowering thereof. The bottom end of the telescoping member is adapted to fit into a tube positioned in the ground. There is a cross bar adjusted to fit on the top telescoping segment with the next segment stopping its dowards movement. A large horizontal ring is mounted on the cross bar. A platform is pivotally mounted under the ring so as to swing downwardly when unlatched and so as to be held firmly in place when latched to the ring. Means can be positioned on the lower side of the pivotal platform which is adapted to contain a boxing bag or similar sports device. A backboard containing a basket ball hoop can be attached to the top of the top telescoping segment on the side away from the cross bar and horizontal ring.

This invention involves one and the same hollow rectangular or any cross-sectional shaped post having two, three or more sections telescopically associated to vary the heights at which multiple games of skills equipment are affixed in order to accommodate individuals of different heights and desires. The post is anchored in the ground by means of a section of a similar hollow rectangular or matching tubing, but sufficiently slightly larger to allow a snug fit. This segment of tubing is burried flush into the ground or in the garage floor or such, in which the post fits snugly for stability. The lower or first section of the telescoping post is fitted with, for example, a winch-type cog which gears into slots cut into the second section for traction. Activating the handle of the winch causes the second section to move up and down as desired to change the height. Attached to the second section is a support for the push-up loop or ring to perform push-ups and such, and to stabilize the boxer's punching bag and the target device located on its back side. Attached immediately under the push-up loop support is a hinged backboard to the preferred size which is secured to the push-up loop by the two stabilizing clamps. When this backboard is in the secured position, a boxer's punching bag is ready for workout. When the stabilizing clamps are disengaged the backboard drops parallel to the post and the top side of the punching bag backboard now displays a target designed in position and to assimulate a baseball game, a football game or any other game of a target nature. In the case of a baseball game the pitcher throws the ball to the catcher (an adhesive surface with a standard target in the center which is also adhesive). The ball sticks to the adhesive surface preferably on target for a home run. Depending upon the skill of the pitcher, any of the rings if hit are worth certain values which permit moving-up to bases. Any ball outside the rings are rightfully called strike one, strike two, and strike out. The next man then pitches. Each player is allowed six balls and his score is determined after he is finished. This is the only baseball game where more than two teams can compete simultaneously together, and one can always be the pitcher of one's own team, the catcher is neutral and the other players are invisible. Any problem which develops must be the making of an incompetent pitcher. To definitely pin down the culprit, a solitaire game of any or all of these games of skill is always possible. It will keep a person occupied, having no one to quarrel with, and will develop skills along with a complete exercise program for the health and development of the human body.

The second section of the post has a second winch-type cog which gears into slots cut into the third section. This wench when manipulated will instantly adjust to the height of the basket ball goal to accommodate a child up to a fully grown individual or up to the official height for basket ball goals.

In view of the overlapping of the telescopically associated tubing, a well calculated length of the two inside tubes (three-in-one) will greatly enhance the strength and stability of the post to support the weight of a fully grown individual making push-ups or such from the push-up loop. A loop or ring in lieu of any form of angular bars for push-ups will tend to converge the weight of the man performing, towards the attachment affixed to the one and the same hollow rectangular or any shape post.

The games of skill equipment are diassembled at the time of procurement—they are ideal holiday presents and the package contains all of the parts, including a tube of metal epoxy, to make it the simpliest multiple installation of games of skill equipment that adults have ever handled. There are no reasons for postponent of its installation. The cooperation or team work displayed amongst the various elements also make it space, installation and cost effective. Installation is preferably outdoors to take advantage of health environments, but the games of skill equipment can be instantly moved indoors. The ground attachments are simply a sunken hollow rectangular or any shape metal piece provided in the package. One metal piece is to be sunk in the ground outdoors and another metal piece is to be sunk in the garage floor or such, both of which are flush to the surface. Any number of such metal pieces can be prelocated at any desirable place. The games of skill equipment post fits snugly into these ground segments to provide stability. To instantly move indoors, or to any other location, lower all games of skill equipment to the lowest level for ease of handling and simply pull out the post and drop it in the indoors or other location segment. Partial or full utilization indoors will depend on the nature of the available space. Because of ceiling heights, the basket ball goal can necessarily have a low profile which can still be fully adequate for a child.

The invention apparatus has a multitude of advantages. The use of one and the same hollow rectangular or any shape post having three segments telescopically associated allows variation of the heights at which multiple games of skill equipment are affixed in order to accommodate individuals of different heights and desires. The hollow rectangular post stabilizes and projects to the desired height, multiple games of skill such as, but not limited to a boxer's punching bag, a target device a loop for push-ups and the like, and a basket ball goal, all affixed to one and the same hollow rectangular or any shape post with the capabilities of instantly adjusting the heights to accommodate a child up to a fully grown individual. The invention apparatus allows easy installation of multiple games of skill equipment which facilitate instant movement from outdoors to indoors or vice/versa for the participation of all concerned from a child to a fully grown individual, all making use of the same set of equipment in view of its wide range of adjustment capabilities. The various games of skill equipment brings adult and child more often together so they can both benefit in many ways and develop skills along with a complete exercise program for the health and development of the human body.

The invention apparatus provides a target game of skill to simulate a base ball game for a solitaire team or any number of team can compete simultaneously together. The person is always the pitcher on his team. The invention further provides a target game of skill to simulate a football game for a solitaire team or any number of teams can compete simultaneously together. The person is always the quarterback of his team. The invention apparatus can be adapted to be a target game of skill to simulate golf or tennis.

BRIEF DESCRIPTION OF THE DRAWINGS

In the drawings:

FIG. 5 is a top elevational view of the ring and pivotable platform of the apparatus of FIG. 1;

FIG. 6 is a top elevational view of the platform of FIG. 1 in the down position;

FIG. 7 is a frontal view of a game target which can be contained on the exposed face of the platform as shown in FIG. 6;

FIG. 8 is a cross-sectional top view of the preferred means for lowering and raising the apparatus in FIG. 1;

FIG. 9 is a top view of adjustment means used in the surface of FIG. 8;

FIG. 10 is a frontal elevational view of one of the lock members of the device of FIG. 8; and FIG. 11 is a frontal view of the gear mechanism of the apparatus of FIG. 8.

DETAILED DESCRIPTION OF THE INVENTION

Advantageous versions of the invention apparatus are described below.

Figure 1:
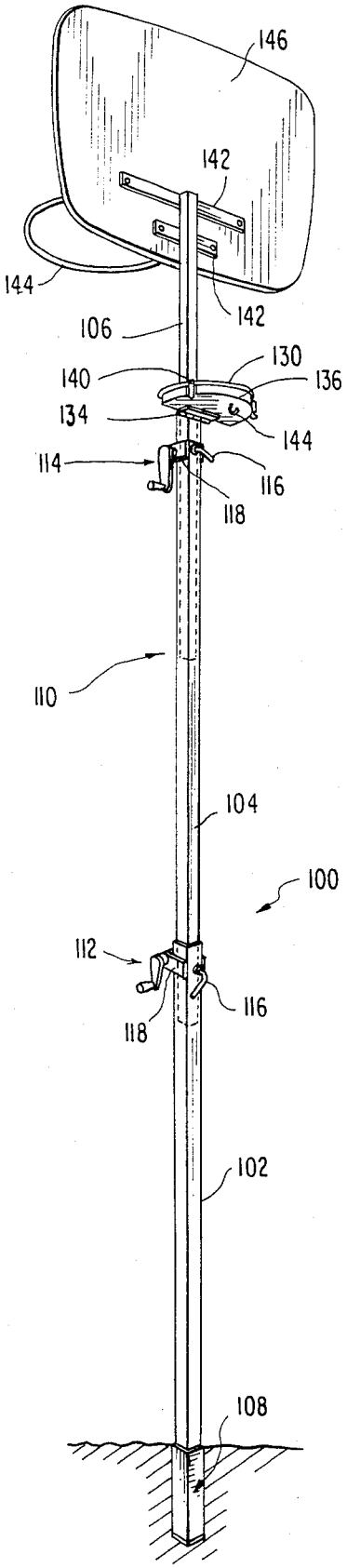
FIG. 1 is a prospective view of the telescoping apparatus of the invention.

Referring to FIG. 1, telescoping support post 100 has lower segment 102, middle segment 104 and upper segment 106. The lower end of post 100 fits into container 108 which is positioned in the ground, concrete or the like, or furnishes support for collapsible, movable health-sports apparatus 110. Apparatus 110 can be moved from position to position and remounted in other containers 108 (not shown). The top of tube 108 is flush with the top of the ground for safety purposes.

Preferably telescoping segments 102, 104 and 106 have a rectangular or square cross-section. Accordingly, container 108 correspondingly has a rectangular or square cross-section. Ratchet 112 and 114 provide means for raising or lowering the various telescoping sections in relationship to each other. In order to hold the telescoping sections in place in relation to each other, L-shaped member 116 threaded on one end is turned into a tightened position against a telescoping member so as to lock the two members into place. A preferred means of holding the telescoping segment in fixed relationship is described below.

Figure 2:
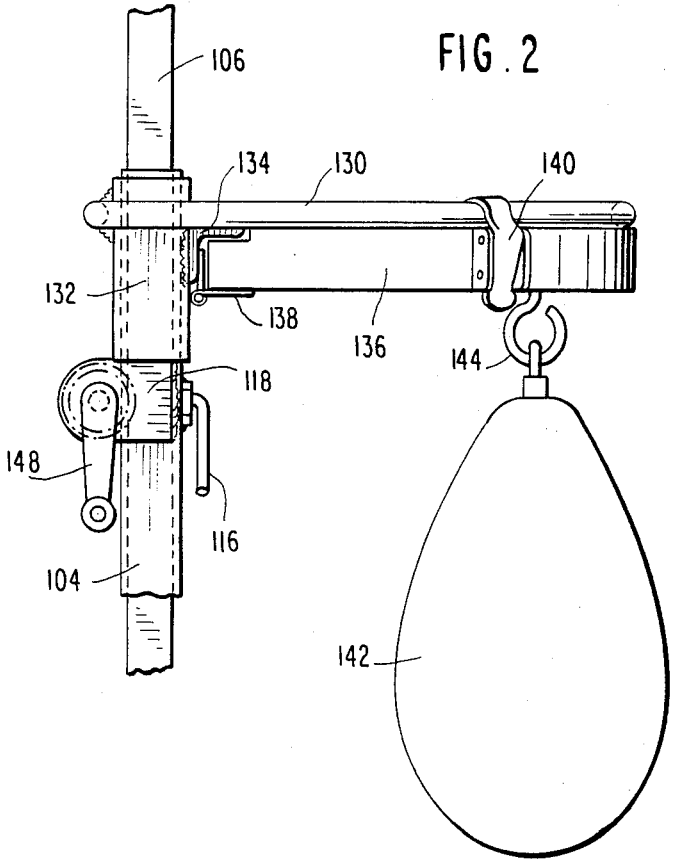
FIG. 2 is a side elevational view of the ring platform region of the telescoping apparatus of FIG. 1.
Figure 3:
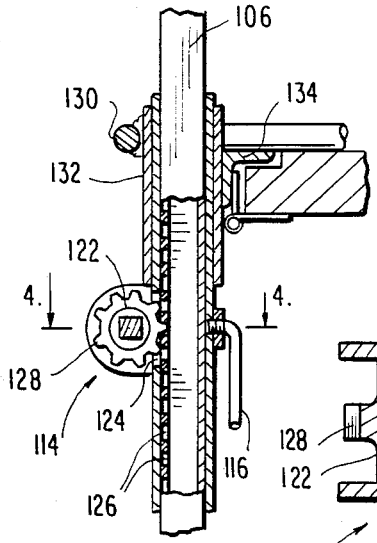
FIG. 3 is a partially-cut away side view of the raising-and-lowering means shown in FIG. 2.
Figure 4:
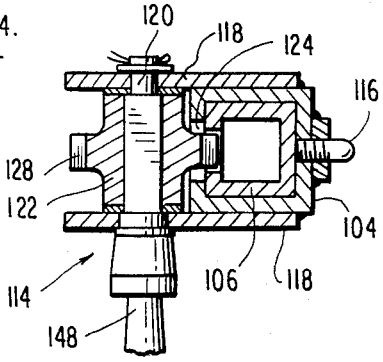
FIG. 4 is a partially-cut away top view of the raising-and-lowering means shown in FIG. 2.

The details of ratchet means 112 and 114 are illustrated in FIGS. 3 and 4, with ratchet means 114 be described below as illustrative for both. Ratchet means 114 is affixed to the side of the top portion of telescoping segments 104 by plates 118—see FIG. 2, for example. Plates 118 are welded to segment 104. Shaft 120 is mounted in two holes in plates 118 and carries ratchet 122 as shown in FIGS. 3 and 4. Handle 148 is mounted on one end of shaft 120. Ratchet 122 extends through aperture 124 in the backside of telescoping segment 104.

The side of telescoping segment 106 facing ratchet 122 has a series of spaced holes 126 which match the ratchet arms 128 of ratchet 122. This is clearly shown in FIG. 3. In this manner, the two telescoping segments 104 and 106 can be moved in relationship to each other to raise or lower post 100. L-shaped arm 116 (has one end externally-threaded) is used to lock the telescoping members in position relative to each other, as desired-,—see FIGS. 3 and 4.

Heavy circular rim 130 is welded or otherwise affixed to the back of short hollow segment 132 in the manner shown in FIGS. 2 and 6. Pipe segment 132 is rectangular in shape and fits onto telescoping segment 104 so as to be supported and rest upon welded cross-member 118. Circular rim 132 is of sufficient gauge as to support a person hanging therefrom, doing chin-ups and the like. Cross plate 134, as best shown in FIG. 6, is welded on each end to the lowest side of circular rim 130 and on its back central side to pipe segment 132. Platform 136 is hinged by means of hinge 138 to the bottom portion of cross-member 134 so as to be pivotable into a vertical position. Platform 136 is shown in the horizontal position in FIG. 2 being held in place by latch members 140. Latch member 140 can be swung into a non-latching position which allows platform 116 to be pivoted into the vertical position as shown in FIGS. 5 and 6 when platform 136 is in the horizontal position. A punching bag (142) or other sports device can be detachably hung from the bottom of platform 136 in the manner shown in FIG. 2. In FIG. 2, punching bag 142 is hung from platform 136 by means of detachable open-eyelet bolt 144. When one desires to pivot platform 136 into the vertical position, punching bag 142 is removed, latches 140 are opened and platform 136 is swung down into its vertical position. Latches 140 at that point are closed so as not to cause a safety problem.

The top side of platform 136 at that point faces an observer as shown in FIG. 5 and can contain game means thereon as shown in FIG. 7. The mechanism of the game means in FIG. 7 has been explained in detail above. When the user wants to convert the device back into the punching bag version or similar sports device, platform 136 is swung up into place and held steady by means of latches 140 as shown in FIG. 2. The height of platform 136 and punching bag 142 can be adjusted upward or downward by means of ratch 112 to provide the ideal height for the user (child or adult).

By means of cross-bars 142 attached to the top of telescoping segment 106, basket ball rim 144 and basket ball backboard 146 can be attached to the top of post 100 in the manner shown in FIG. 1. Rim 144 and backboard 146 are positioned on the side of post 100 opposite that of platform 136 and ring 130, the height of rim 144 and backboard 146 can be adjusted as desired by means of ratchets 112 and 114.

In the above version, the expansion can be manipulated in such a fashion that both winches are within reach or can be adjusted to where even a child can reach them for operation. The hook for the punch bag should be centered under the backboard so that it will always fit the surface at any angle and bounce back.

The preferred means for raising and lowering the post device 100 shown in FIG. 1 is illustrated in FIG. 8. Such preferred raising and lowering means 200 has base plate 202 which is affixed against the top of telescoping segment 102 or telescoping segment 104 in the manner in which winch means 112 and 114 are shown in FIG. 1. Gear arms 204 fit into holes 126 in telescoping member 106 as illustrated for gear means 114 shown in FIG. 3. Base plate 202 is screwed or bolted to the appropriate telescoping segment using holes 206 in base plate 204. If desired other attachment means, such as welding, can be used in bolting.

Device 200 contain front plate and back plate 210 as well as top plate 212. Device 200 is totally enclosed by side plates (not shown) in FIG. 8. Front plate 210 has a central hole therein wherein cylindrical portion 214 of gear member 216 rotably fits. Gear means 216 is best illustrated in FIG. 11. The flat inner face between cylindrical portion 248 and cylindrical portion 214 faces against the inner surface of front plate 208. Base plate 202 contains hole 218 through which projects gear means 204 as shown in FIG. 8. The top surface of cylindrical portion 214 of gear member 216 contains square hole 220 into which fits turning arm 222. Turning arm 222 can be removed from hole 220 for safety purposes, that is, so someone does not hit it when moving around post 110. Cylindrical pin 224 is located on the bottom central axis of gear member 216. Four equally spaced hemispheres 226 are located on bottom surface 228 of gear means 216.

Elongated rod 230 as shown in FIG. 8 has a cylindrical hole in the bottom thereof into which fits cylindrical pin 224 of gear means 216. Lock ring 232 as shown in FIG. 10 has a central square hole 234. The inner end of elongated rod 240, which has a square cross-section is welded into hole 234 of lock ring 232. This is best illustrated in FIG. 8. The surface of lock ring 232 facing bottom surface 228 of gear means 216 has four equally spaced hemispheres 236 which match hemispheres 226 on the bottom surface 228 of gear means 216. As illustrated in FIG. 8 ball bearings 238 fit into hemispheres 226 and 236. As will be shown this provides means for advancing and breaking the movement of the telescoping sections of post 110.

The outer end of elongated rod 230 fits into square hole 240 in the bottom of screw means 242 as shown in FIG. 8. Screw means 242 is externally threaded and fits into an externally threaded hole in back plate 210. Spring 244 fits around elongated rod 230 being seated against the bottom of screw means 242 and against the inner surface of lock ring 232. While spring 242 and the weight of the load may have a tendency to turn screw means 242 to unthread, the use of a set screw in internally threaded hole 246 (shown in FIG. 9) allows one to prevent the rotational movement of screw means 242.

In operation, the user inserts the end of handle 222 into hole 220 and rotates gear means 216 thereby advancing or lowering two telescoping segments in relationship to each other. The turning of gear means 216 will cause ball bearings 238 to become unseated from hemispheres 226 and pass rotationally into the next hemisphere 226. About three quarters of each ball bearing 238 should be contained in hemispheres 236 of lock ring 232 in order to prevent the movement of ball bearing 238 out of hemisphere 236 upon the rotation of plate 232. The pressure of spring 244 holds back plate 232 firmly against ball bearing 238. The pressure exerted by spring 244 can be adjusted by screw means 242 in or out. The braking action of device 200 is provided by the dropping of ball bearing 238 into each approaching hemisphere 226 as gear means 216 is rotated. It requires a certain degree of force upon handle 222 in order to move ball bearing 238 between hemisphere 236. Also, such braking mechanism prevents the weight of device 100 from forcing the rotation of gear means 216.

Winch 200 can be used in other applications besides the one described above. For heavy duty applications, such as lifting heavy weights, one or more reduction gears can be used in a motorized power train (i.e., in place of handle 222). A reel arrangement or groove can be used in place of teeth 204 of part 216 for ropes, cables and the like. Or, cylindrical part 248 can be used as a reel for rope, cable, etc., with an exit slot being provided therefor in the top, bottom or side plates of device 200.

What is claimed is:

1. Collapsible, movable apparatus for containing health-sports devices and equipment comprising:

(a) a telescoping post support having at least two telescoping segments;

(b) means for moving each of the adjacent telescoping segments in relation to each other;

(c) support means adopted to fit slidably on the top telescoping segment without overlapping onto the next telescoping segment;

(d) a large horizontally-positioned ring mounted on support means (c);

(e) a platform pivotally mounted under the ring so as to be able to swing downwardly when unconnected from the ring; and (f) a basket ball backboard vertically mounted to the top portion of the top telescoping segment, the bottom end of the telescoping post being adapted to fit into a tube positioned in the ground or other horizontal surface.

2. Apparatus as claimed in claim 1 wherein there are three telescoping segments, each of which has a rectangular cross-section.

3. Apparatus as claimed in claim 2 wherein each telescoping segment has a series of regularly spaced holes along one face thereof, and wherein the moving means is a gear means mounted on one telescoping segment with the gears thereof mating with the regularly spaced holes of the other telescoping member, thereby providing relative movement.

4. Apparatus as claimed in claim 3 wherein the gear means is provided with braking means.

5. Apparatus as claimed in claim 1 wherein platform (e) is held in its upper position by at least one latch mounted on the ring.

6. Apparatus as claimed in claim 1 wherein the platform and backboard are positioned on opposite sides of the post support.

7. Apparatus as claimed in claim 1 wherein a basket ball hoop is mounted on the front of the backboard.

8. Apparatus as claimed in claim 1 wherein a punching bag is detachably mounted on the bottom surface of the platform.

9. A brake winch comprising:

(a) a casing which includes a first end, a second end, and a side cover which contains an opening therein near said first end of said casing, said first end having a central aperture and said second end having a central aperture;

(b) gear means positioned within said casing having a shaft rotatably positioned in said aperture of said first end of said casing, said gear means having a cylindrical shape and having teeth around the perimeter thereof, said teeth of said gear means being of sufficient length so as to substantially protrude through said opening in said side cover of said casing, a short central rod being positioned on the flat side of said gear means, facing said second end of said casing, a plurality of small indentations in said flat face of said gear means facing the second end of said casing and being located equidistant from each other on a circular line having said central rod as its center point;

(c) a cap threadingly positioned in the said aperture of said second end of second casing, of said cap having a hole in the inner-facing portion therein;

(d) a hollow shaft fixedly positioned on one end in said hollow portion of said cap and fitting over said short central rod of said gear means facing said end of said casing in such a manner that said hollow shaft is rotatable in relationship to said short shaft, the bottom portion of hollow shaft being an extended rim, a plurality of small indentations in said flat face of said extended rim of said hollow shaft and being the identical number to said small indentations in said flat surface of said gear means;

(e) a spring being located around hollow shaft between said extended rim of said hollow shaft and the bottom surface of said cap means, said spring pressing said rim against said gear means when said cap means is turned inwardly; and (f) a plurality of ball bearings or other spheroid objects positioned each of said sets of small indentations, said ball bearings serving to lock said gear means in place and to serve as a brake on the turning of said gear means, a hole being located in the extended surface of said portion of said gear means which rotatably fits in said first end of said case, to facilitate the insertion of a handle for the turning of said gear means.

* * * * *